US010076136B2

(12) United States Patent
Kadiric

(10) Patent No.: US 10,076,136 B2
(45) Date of Patent: Sep. 18, 2018

(54) SMOKING ARTICLE WRAPPER WITH WINDOW

(71) Applicant: PHILIP MORRIS PRODUCTS S.A., Neuchatel (CH)

(72) Inventor: Alen Kadiric, Orpund (CH)

(73) Assignee: Philip Morris Products S.A., Neuchatel (CH)

( * ) Notice: Subject to any disclaimer, the term of this patent is extended or adjusted under 35 U.S.C. 154(b) by 25 days.

(21) Appl. No.: 14/900,828

(22) PCT Filed: Jul. 14, 2014

(86) PCT No.: PCT/EP2014/065050
§ 371 (c)(1),
(2) Date: Dec. 22, 2015

(87) PCT Pub. No.: WO2015/007690
PCT Pub. Date: Jan. 22, 2015

(65) Prior Publication Data

US 2016/0174608 A1 Jun. 23, 2016

(30) Foreign Application Priority Data

Jul. 18, 2013 (EP) ..... 13177126

(51) Int. Cl.
*A24F 47/00* (2006.01)
*A24D 1/02* (2006.01)

(52) U.S. Cl.
CPC ..... *A24F 47/006* (2013.01); *A24D 1/02* (2013.01)

(58) Field of Classification Search
None
See application file for complete search history.

(56) References Cited

U.S. PATENT DOCUMENTS 2,992,647 A 7/1961 Figge
2012/0240948 A1* 9/2012 Griesmayr ..... A24D 1/02 131/229

FOREIGN PATENT DOCUMENTS

CH 374011 12/1963
EP 2671460 12/2013
(Continued)

OTHER PUBLICATIONS

PCT Search Report and Written Opinion for PCT/EP2014/065050 dated Aug. 28, 2014 (6 pages).
(Continued)

*Primary Examiner* — Alison L Hindenlang
*Assistant Examiner* — Jamel M Nelson
(74) *Attorney, Agent, or Firm* — Mueting, Raasch & Gebhardt, P.A.

(57) ABSTRACT

A wrapper (510) for a smoking article comprises a sheet material extending in a first direction (24) in which the wrapper (510) is wrapped around a smoking article and a second direction (20) perpendicular to the first direction (24). The wrapper further comprises a window (512) in the sheet material, the window (512) having a perimeter wherein the perimeter comprises a first portion (518) that defines a projection (516) of the sheet material into the window (512). The projection (516) is delimited by the first portion (518) of the perimeter and a straight line (520) forming a tangent to each end (522, 524) of the first portion (518) of the perimeter, and the distance between the straight line (520) and the point on the first portion (518) of the perimeter furthest from the straight line (520) in a direction perpendicular to the straight line (520) is less than 1 millimeter.

20 Claims, 3 Drawing Sheets

(56) References Cited

FOREIGN PATENT DOCUMENTS

| | | | | |
|---|---|---|---|---|
| WO | WO 03/034847 | | 5/2003 | |
| WO | WO 2011038430 | A1 * | 4/2011 | ..... A24D 1/02 |
| WO | WO 2011/154246 | | 12/2011 | |

OTHER PUBLICATIONS

European Extended Search Report for Application No. 13177126.3 dated Jan. 29, 2014 (5 pages).

* cited by examiner

SMOKING ARTICLE WRAPPER WITH WINDOW

This application is a U.S. National Stage Application of International Application No. PCT/EP2014/065050, filed Jul. 14, 2014, which was published in English on Jan. 22, 2015 as International Patent Publication WO 2015/007690 A1. International Application No. PCT/EP2014/065050 claims priority to European Application No. 13177126.3 filed Jul. 18, 2013.

The present invention relates to a wrapper for a smoking article, the wrapper formed from a sheet material having a window. The present invention also relates to smoking articles comprising such a wrapper.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper, normally formed of an opaque paper material that circumscribes the entire length of the filter and an adjacent portion of the wrapped tobacco rod.

A number of smoking articles in which tobacco is heated rather than combusted have also been proposed in the art. In heated smoking articles, an aerosol is generated by heating a flavour generating substrate, such as tobacco. Known heated smoking articles include, for example, electrically heated smoking articles and smoking articles in which an aerosol is generated by the transfer of heat from a combustible fuel element or heat source to a physically separate aerosol forming material. During smoking, volatile compounds are released from the aerosol forming substrate by heat transfer from the fuel element and entrained in air drawn through the smoking article. As the released compounds cool they condense to form an aerosol that is inhaled by the consumer. Smoking articles in which a nicotine-containing aerosol is generated from a tobacco material, tobacco extract or other nicotine source, without combustion or heating, are also known.

Sometimes it is desirable to provide a smoking article wrapper, such as a tipping wrapper, with an aperture extending therethrough, so that the aperture forms a window to permit a consumer to view the underlying portion of the smoking article. However, the present inventors have recognised that when such a window includes a projection of the sheet material extending into the window, the lack of tension in the projection when the wrapper is wrapped around a smoking article may result in the projection tending to lift away from the underlying smoking article. This problem is exacerbated by the fact that it is impractical to locate any adhesive between the projection and the underlying smoking article without the adhesive creeping into the window itself. Such lifting of projections within windows is undesirable since it creates a portion of the wrapper which may become caught on production line machinery and it reduces the perceived quality of the product. It would therefore be desirable to provide a wrapper for a smoking article, the wrapper having a window with a projection extending therein and arranged such that lifting of the projection away from the smoking article is reduced or eliminated.

The present invention provides a wrapper for a smoking article, the wrapper comprising a sheet material extending in a first direction in which the wrapper is wrapped around a smoking article and a second direction perpendicular to the first direction. The wrapper further comprises a window in the sheet material, the window having a perimeter wherein the perimeter comprises a first portion that defines a projection of the sheet material into the window. The projection is delimited by the first portion of the perimeter and a straight line forming a tangent to each end of the first portion of the perimeter, and the distance between the straight line and the point on the first portion of the perimeter furthest from the straight line in a direction perpendicular to the straight line is less than 1 millimeter, preferably less than 0.5 millimeters.

The term "window" is used herein to mean any aperture, opening or cut-out extending through the sheet material. Although the window may be formed using conventional methods such as die cutting, the window is preferably formed using laser cutting.

The sheet material extends in a first direction and a second direction perpendicular to the first direction. The first direction is the direction of wrapping, that is, the direction in which the wrapper is wrapped when wrapped around a smoking article. Once wrapped, the second direction is parallel to the longitudinal axis of the smoking article.

The term "perimeter" is used herein to mean the inside edge of the sheet material that delimits the window. Therefore, the perimeter is a closed loop. The perimeter is formed from one or more line segments, which may be linear, curved, or a combination of the two. For example, an ellipse may be formed from a single curved line segment and a square is formed from four linear line segments.

Figure 1:
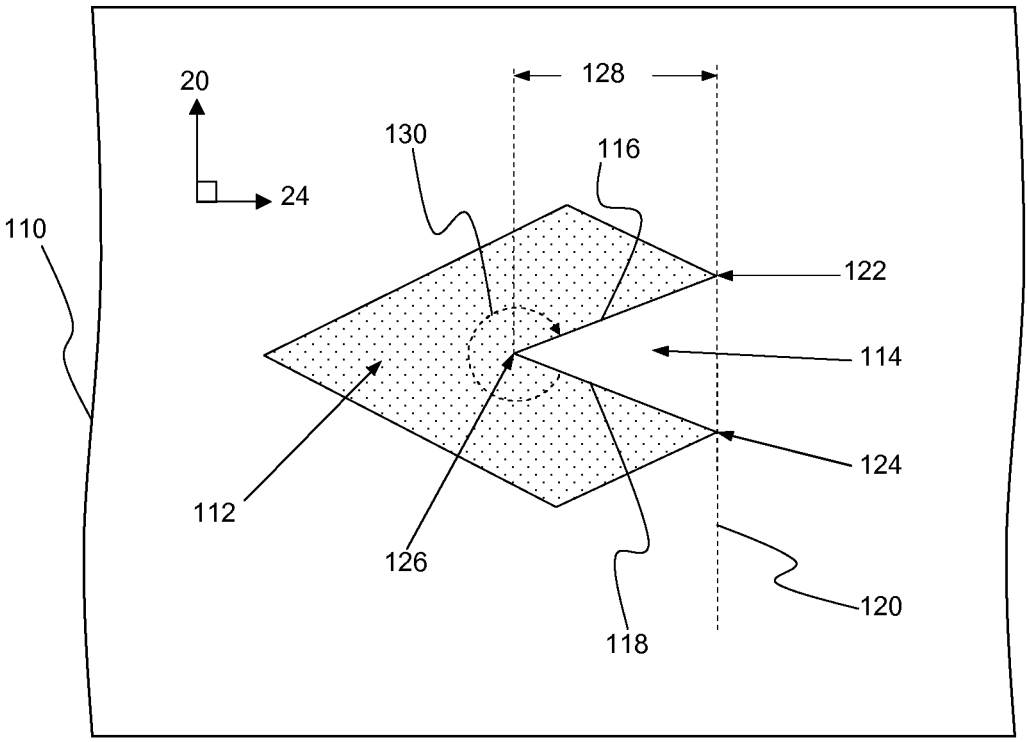
FIGS. 1-3 are schematic plan views of wrappers illustrating a concept of a straight line forming a tangent to each end of a first portion of a perimeter to delimit a projection.
Figure 2:
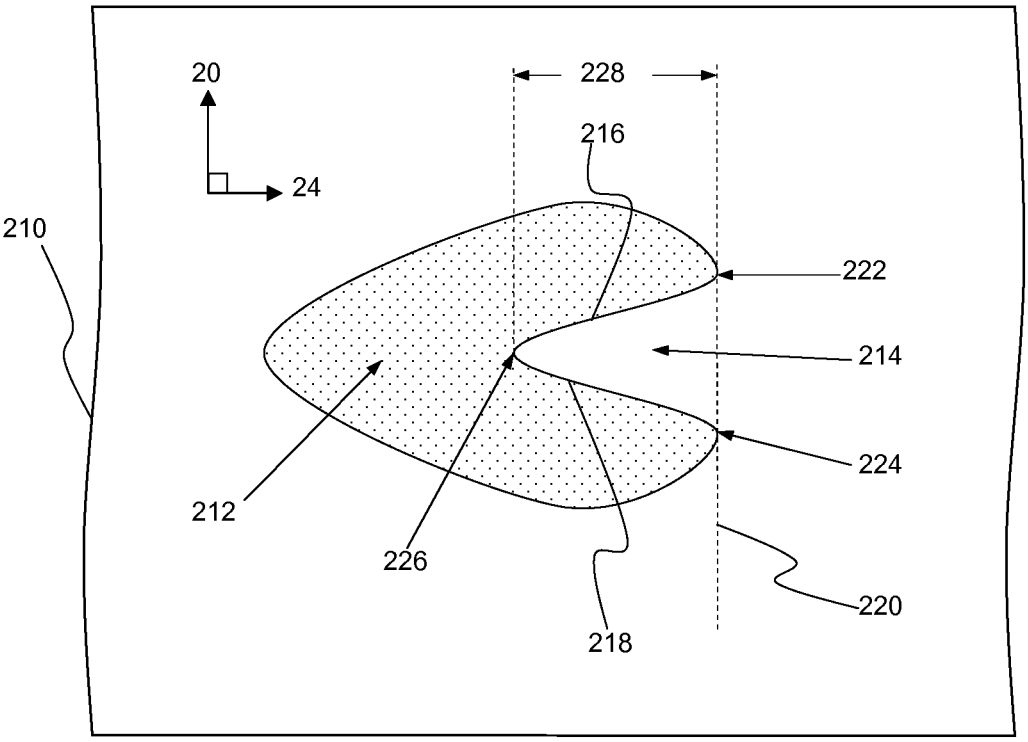
Figure 3:
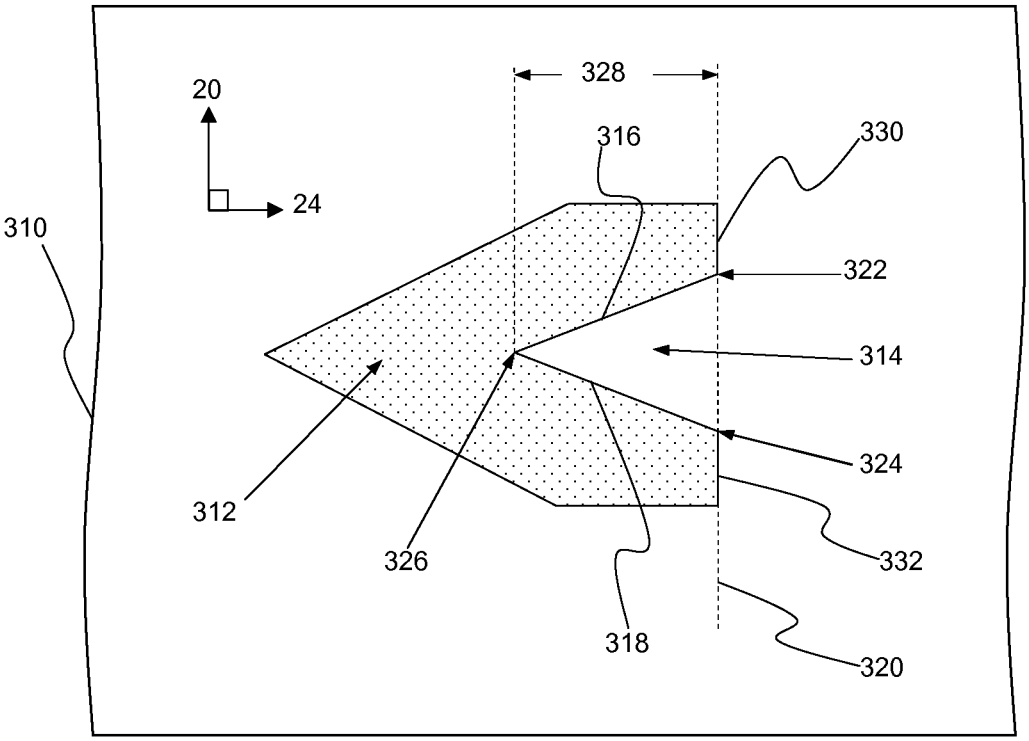

The concept of a straight line forming a tangent to each end of a first portion of the perimeter to delimit a projection is illustrated in FIGS. 1, 2 and 3, which are provided to illustrate this concept only and are not intended to limit the scope of the invention. For example, FIG. 1 shows a wrapper 110 having a window 112 into which a portion of the sheet material extends to form a projection 114. The projection 114 is delimited by a first portion of the perimeter consisting of two linear line segments 116 and 118, and a straight line 120 forming a tangent to the end points 122, 124 of the first portion. The distance between the straight line 120 and the point 126 on the first portion furthest from the straight line 120 in a direction perpendicular to the straight line 120 is indicated by reference numeral 128.

A similar arrangement is illustrated in FIG. 2, which shows a wrapper 210 comprising a window 212 having a similar shape but formed from curved line segments. In this case, a portion of the sheet material extends into the window 212 to form a projection 214. The projection 214 is delimited by a first portion of the perimeter consisting of two curved line segments 216 and 218, and a straight line 220 forming a tangent to the end points 222, 224 of the first portion. The distance between the straight line 220 and the point 226 on the first portion furthest from the straight line 220 in a direction perpendicular to the straight line 220 is indicated by reference numeral 228.

Finally, FIG. 3 illustrates a special case in which each end 322, 324 of the first portion of the perimeter joins to a linear line segment 330, 332 of the perimeter, wherein the two linear line segments 330, 332 are parallel and lie on the same line. In this case, the straight line 320 forming a tangent to the end points 322, 324 of the first portion is a straight line connecting the two linear line segments 330, 332.

The present inventors have recognised that, when forming a wrapper having a window with a projection of the sheet material extending therein, it is advantageous to form the projection so that the distance between the straight line forming a tangent to each end of the first portion of the perimeter defining the projection and the point on the first portion furthest from the straight line in a direction perpendicular to the straight line is less than 1 millimeter. Specifically, by forming a projection having such a dimension, lifting of the projection away from a smoking article is substantially reduced or eliminated when the wrapper is wrapped around a smoking article.

In some embodiments, the first portion of the perimeter comprises at least one straight line having a length of at least 0.5 millimeters and the first portion defines one or more internal angles of the window, each of the one or more internal angles being less than 220°. The first portion may comprise two straight line segments each having a length of at least 0.5 millimeters and wherein the two straight line segments converge to form a vertex of the projection, the internal angle of the window at the vertex being less than 220°.

The term "internal angle" is used herein to mean an angle measured between two line segments of the perimeter, wherein the angle extends through the window rather than through the sheet material. For example, FIG. 1 shows the internal angle 130 of the window at the vertex of the projection 114. For a projection, the internal angle must be at least 180°, otherwise the sheet material will not extend into the window to form a projection.

In those embodiments in which the window shape is such that the perimeter defines more than one projection of the sheet material into the window, the distance between the straight line forming a tangent to each end of the portion of the perimeter defining the projection and the point on the portion of the perimeter defining the projection furthest from the straight line in a direction perpendicular to the straight line is preferably less than 1 millimeter for every projection, more preferably less than 0.5 millimeters for every projection.

Preferably, the window has a width in the second direction of less than about 7 millimeters, more preferably less than about 5 millimeters, more preferably less than about 3 millimeters. Preferably, the window has a width of at least about 2 millimeters. The term "width" is used herein to refer to the distance in the second direction between the two extremities of the perimeter on each side of the window in the second direction.

Preferably, the window has a height in the first direction of less than about 80 percent of a height of the wrapper in the first direction. The window preferably has a height of at least about 5 percent of a height of the wrapper in the first direction. The term "height" is used herein to refer to the distance in the first direction between the two extremities of the perimeter on each side of the window in the first direction.

In some embodiments, the window has an area of less than about 30 $mm^2$. Preferably, the window has an area of at least about 2.5 $mm^2$.

Preferably, the shape of the window is arranged such that any linear segment of the perimeter forming an angle of less than 10° with respect to the second direction has a length of less than 0.5 millimeters, and any curved portion of the perimeter having a continuum of tangents each forming an angle of less than 10° with respect to the second direction has a length of less than 0.5 millimeters. Such linear segments and curved portions of the perimeter are spaced apart by a distance of at least 0.5 millimeters along the length of the perimeter. Advantageously, this arrangement minimises the length of the perimeter that extends parallel to or substantially parallel to the second direction, which the present inventors have recognised minimises or eliminates lifting of the wrapper in the vicinity of the window when the wrapper is wrapped in the first direction around a smoking article.

Figure 4:
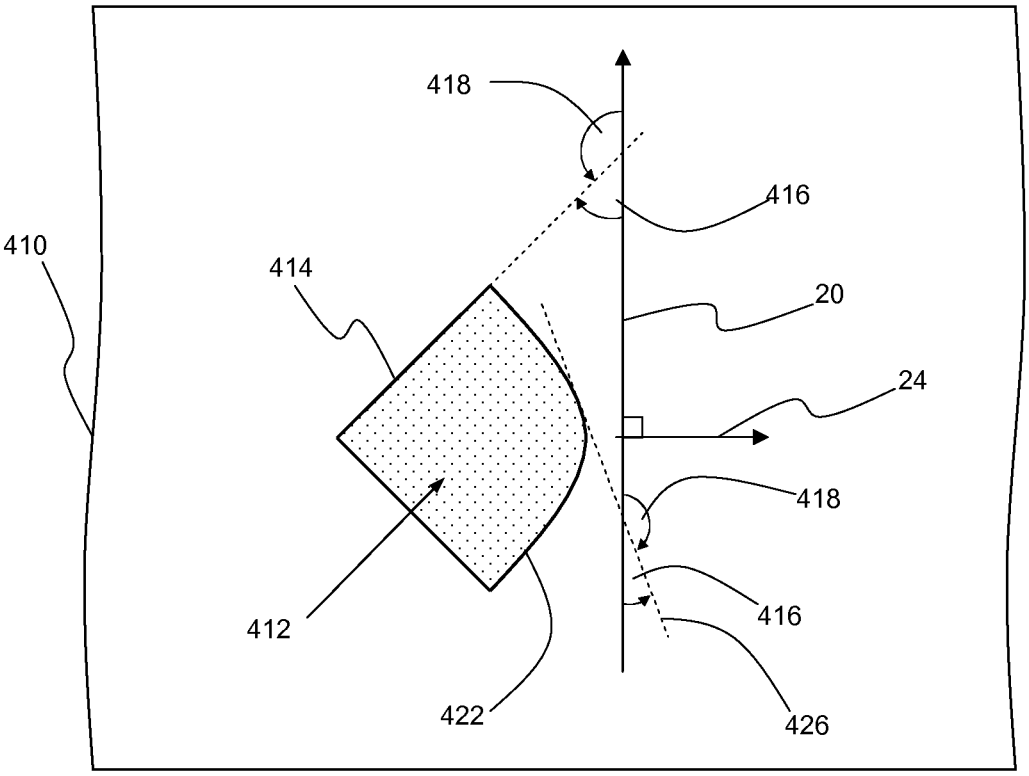
FIG. 4 is a schematic plan view of a wrapper illustrating the concept of tangents to line segments forming angles with respect to a direction.

In this regard, the skilled person will appreciate that each line segment of the perimeter forms two angles with respect to the second direction. For example, as shown in FIG. 4, which illustrates a portion of a wrapper 410 having a window 412, the linear line segment 414 forms a first angle 416 and a second angle 418 with respect to the second direction 20. Similarly, a series of tangents to the curved line segment 422 will each form a first angle 416 and a second angle 418 with respect to the second direction 20. For clarity, only a single tangent 426 is shown in FIG. 4; however, the skilled person will appreciate that a tangent can be drawn at any point along a curved line segment such that any curved line segment will have an associated series of tangents along its length. Such a series of tangents is referred to herein as a "continuum of tangents". The term "continuum of tangents" may be used to refer to a series of tangents along the entire length of a curved line segment or a continuous subset of such tangents along only part of the curved line segment. As used herein, the term "curved portion" may refer to an entire curved line segment, or only a part of such a line segment.

The wrapper shown in FIG. 4 is for illustrating the concept of line segments forming angles with respect to the second direction only and does not fall within the scope of the present invention.

All references herein to a single angle between a linear line segment and the second direction or an angle between a tangent to a curved line segment and the second direction refer to the first angle 416, that is, the acute angle. In the special case in which the linear line segment or the tangent extends in the first direction 24, the angle is 90°.

In some embodiments, the perimeter includes at least one linear segment forming an angle of less than 10° with respect to the second direction and having a length of less than 0.5 millimeters. Additionally, or alternatively, the perimeter may include at least one curved portion having a continuum of tangents each forming an angle of less than 10° with respect to the second direction and having a length of less than 0.5 millimeters.

The present invention also extends to smoking articles including the inventive wrapper in accordance with any of the embodiments described above. For example, the smoking article may comprise an aerosol generating substrate, a mouthpiece and a wrapper in accordance with the present invention. The wrapper is wrapped around at least a portion of the mouthpiece and at least a portion of the aerosol generating substrate to secure the mouthpiece to the aerosol generating substrate.

In some embodiments of the smoking article, a continuous portion of the wrapper surrounding the perimeter of the window is free from adhesive, wherein the width of the continuous portion is at least about 0.5 millimeters, preferably at least about 1 millimeter. Preferably, the projection of the sheet material into the window is completely free from adhesive.

The smoking article may be a conventional filter cigarette, such that the aerosol generating substrate is a tobacco rod, the mouthpiece comprises one or more segments of filtration material, and the wrapper is a tipping wrapper.

Figure 5:
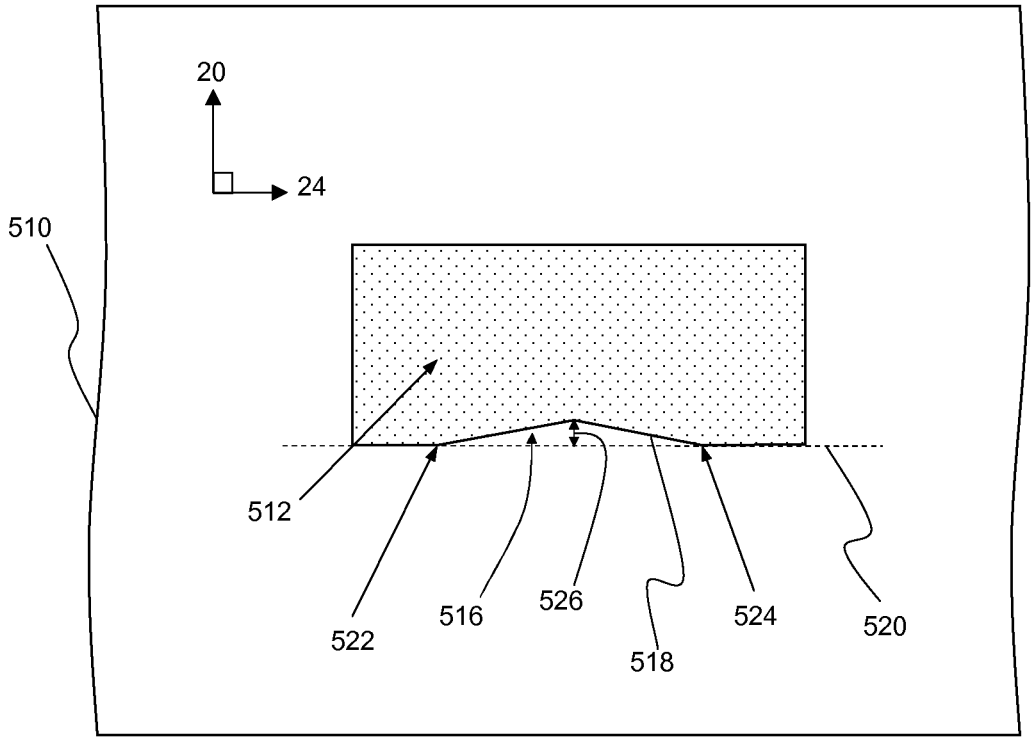
FIG. 5 is a schematic plan view of a wrapper having a window formed from a series of linear line segments.
Figure 6:
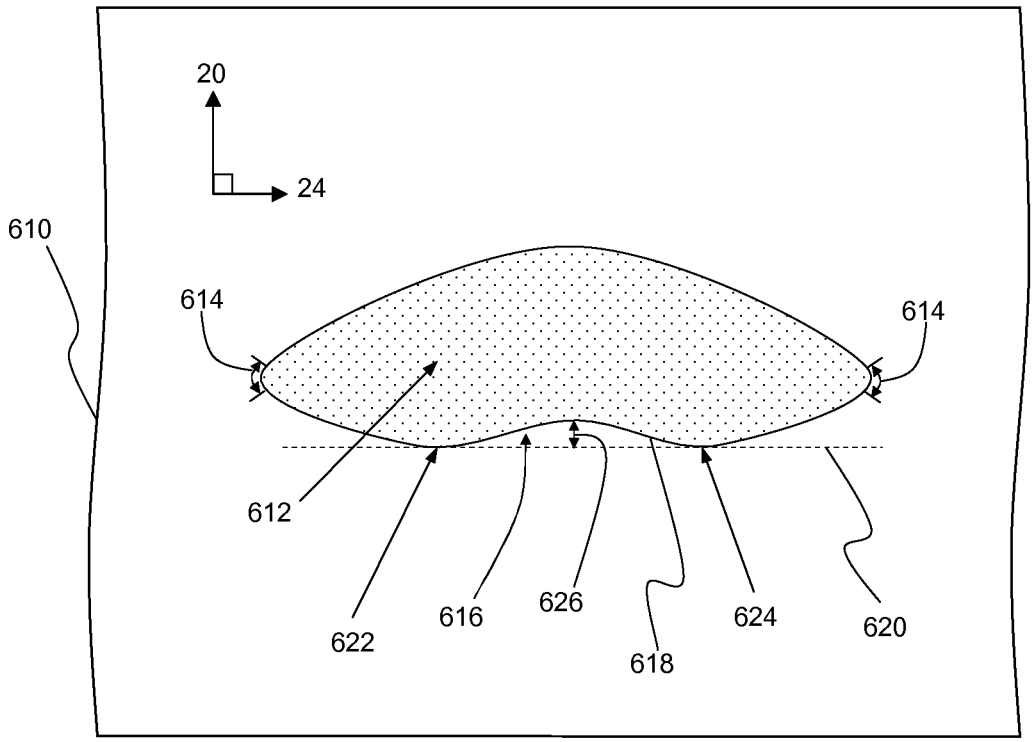
FIG. 6 is a schematic plan view of a wrapper having an alternative window formed from a series of curved line segments.

The invention will now be further described, by way of example only, with reference to the accompanying drawings in which:

FIG. 5 shows a wrapper in accordance with a first embodiment of the present invention; and FIG. 6 shows a wrapper in accordance with a second embodiment of the present invention.

FIG. 5 shows a wrapper 510 having a window 512 formed from a series of linear line segments. The wrapper 510 includes a projection 516 that extends into the window 512 and is delimited by a first portion 518 of the perimeter and a straight line 520 that forms a tangent to the two end points 522, 524 of the first portion 518. The distance 526 between the straight line 520 and the point on the first portion 518 furthest from the straight line 520 in a direction perpendicular to the straight line is less than 1 millimeter.

FIG. 6 shows a wrapper 610 having an alternative window 612 formed from a series of curved line segments. The only curved portions 614 of the perimeter that have a continuum of tangents that each form an angle of less than 10° with respect to the second direction 20 are both shorter than 0.5 millimeters.

The wrapper 610 further includes a projection 616 that extends into the window 612 and is delimited by a first portion 618 of the perimeter and a straight line 620 that forms a tangent to the two end points 622, 624 of the first portion 618. The distance 626 between the straight line 620 and the point on the first portion 618 furthest from the straight line 620 in a direction perpendicular to the straight line is less than 1 millimeter.

The invention claimed is:

1. A smoking article comprising:

an aerosol generating substrate;

a mouthpiece; and a wrapper wrapped around at least a portion of the mouthpiece and at least a portion of the aerosol generating substrate to secure the mouthpiece to the aerosol generating substrate, wherein the wrapper comprises:

a sheet material extending in a first direction in which the wrapper is wrapped around the mouthpiece and the aerosol generating substrate, and a second direction perpendicular to the first direction; and a window in the sheet material, the window having a perimeter;

wherein the perimeter comprises a first portion that defines a projection of the sheet material into the window;

wherein the projection is delimited by the first portion of the perimeter and a straight line forming a tangent to each end of the first portion of the perimeter; and wherein the distance between the straight line and the point on the first portion of the perimeter furthest from the straight line in a direction perpendicular to the straight line is less than 1 millimeter.

2. A smoking article according to claim 1, wherein a continuous portion of the wrapper surrounding the perimeter of the window is free from adhesive, wherein the width of the continuous portion is at least about 0.5 millimeters.

3. A smoking article according to claim 1, wherein the projection of the sheet material extending into the window is completely free from adhesive.

4. A smoking article according to claim 2, wherein the projection of the sheet material extending into the window is completely free from adhesive.

5. A smoking article according to claim 1, wherein the first portion of the perimeter comprises at least one straight line segment having a length of at least 0.5 millimeters and wherein the first portion of the perimeter defines one or more internal angles of the window, each of the one or more internal angles being less than 220°.

6. A smoking article according to claim 5, wherein the first portion of the perimeter comprises two straight line segments each having a length of at least 0.5 millimeters and wherein the two straight line segments converge to form a vertex of the projection, the internal angle of the window at the vertex being less than 220°.

7. A smoking article according to claim 2, wherein the first portion of the perimeter comprises at least one straight line segment having a length of at least 0.5 millimeters and wherein the first portion of the perimeter defines one or more internal angles of the window, each of the one or more internal angles being less than 220°.

8. A smoking article according to claim 7, wherein the first portion of the perimeter comprises two straight line segments each having a length of at least 0.5 millimeters and wherein the two straight line segments converge to form a vertex of the projection, the internal angle of the window at the vertex being less than 220°.

9. A smoking article according to claim 1, wherein any projection of the sheet material into the window is delimited by a portion of the perimeter and a straight line forming a tangent to each end of the portion of the perimeter, and wherein the distance between the straight line and the point on the portion of the perimeter furthest from the straight line in a direction perpendicular to the straight line is less than 1 millimeter.

10. A smoking article according to claim 2, wherein any projection of the sheet material into the window is delimited by a portion of the perimeter and a straight line forming a tangent to each end of the portion of the perimeter, and wherein the distance between the straight line and the point on the portion of the perimeter furthest from the straight line in a direction perpendicular to the straight line is less than 1 millimeter.

11. A smoking article according to claim 1, wherein any linear segment of the perimeter forming an angle of less than 10° with respect to the second direction has a length of less than 0.5 millimeters, and wherein any curved portion of the perimeter having a continuum of tangents each forming an angle of less than 10° with respect to the second direction has a length of less than 0.5 millimeters, and wherein such linear segments and curved portions of the perimeter are spaced apart by a distance of at least 0.5 millimeters along the length of the perimeter.

12. A smoking article according to claim 11, wherein the perimeter includes at least one linear segment forming an angle of less than 10° with respect to the second direction and having a length of less than 0.5 millimeters.

13. A smoking article according to claim 11, wherein the perimeter includes at least one curved portion having a continuum of tangents each forming an angle of less than 10° with respect to the second direction and having a length of less than 0.5 millimeters.

14. A smoking article according to claim 1, wherein the aerosol generating substrate is a tobacco rod, wherein the mouthpiece comprises one or more segments of filtration material, and wherein the wrapper is a tipping wrapper.

15. A wrapper for a smoking article, the wrapper comprising:

a sheet material extending in a first direction in which the wrapper is wrapped around a smoking article and a second direction perpendicular to the first direction; and a window in the sheet material, the window having a perimeter;

wherein the perimeter comprises a first portion that defines a projection of the sheet material into the window;

wherein the projection is delimited by the first portion of the perimeter and a straight line forming a tangent to each end of the first portion of the perimeter; and wherein the distance between the straight line and the point on the first portion of the perimeter furthest from the straight line in a direction perpendicular to the straight line is less than 1 millimeter.

16. A wrapper according to claim 15, wherein the first portion of the perimeter comprises at least one straight line segment having a length of at least 0.5 millimeters and wherein the first portion of the perimeter defines one or more internal angles of the window, each of the one or more internal angles being less than 220°.

17. A wrapper according to claim 15, wherein any projection of the sheet material into the window is delimited by a portion of the perimeter and a straight line forming a tangent to each end of the portion of the perimeter, and wherein the distance between the straight line and the point on the portion of the perimeter furthest from the straight line in a direction perpendicular to the straight line is less than 1 millimeter.

18. A wrapper according to claim 16, wherein any projection of the sheet material into the window is delimited by a portion of the perimeter and a straight line forming a tangent to each end of the portion of the perimeter, and wherein the distance between the straight line and the point on the portion of the perimeter furthest from the straight line in a direction perpendicular to the straight line is less than 1 millimeter.

19. A wrapper according to claim 15, wherein any linear segment of the perimeter forming an angle of less than 10° with respect to the second direction has a length of less than 0.5 millimeters, and wherein any curved portion of the perimeter having a continuum of tangents each forming an angle of less than 10° with respect to the second direction has a length of less than 0.5 millimeters, and wherein such linear segments and curved portions of the perimeter are spaced apart by a distance of at least 0.5 millimeters along the length of the perimeter.

20. A wrapper according to claim 16, wherein any linear segment of the perimeter forming an angle of less than 10° with respect to the second direction has a length of less than 0.5 millimeters, and wherein any curved portion of the perimeter having a continuum of tangents each forming an angle of less than 10° with respect to the second direction has a length of less than 0.5 millimeters, and wherein such linear segments and curved portions of the perimeter are spaced apart by a distance of at least 0.5 millimeters along the length of the perimeter.

* * * * *